US009254979B2

(12) United States Patent
Cox

(10) Patent No.: US 9,254,979 B2
(45) Date of Patent: Feb. 9, 2016

(54) CUTTING-AND-SEPARATING DEVICE

(75) Inventor: Bernd Cox, Weeze (DE)

(73) Assignee: KHS GmbH, Dortmund (DE)

( * ) Notice: Subject to any disclaimer, the term of this patent is extended or adjusted under 35 U.S.C. 154(b) by 1204 days.

(21) Appl. No.: 13/125,626

(22) PCT Filed: Jan. 20, 2010

(86) PCT No.: PCT/EP2010/000314
§ 371 (c)(1),
(2), (4) Date: Apr. 22, 2011

(87) PCT Pub. No.: WO2010/091771
PCT Pub. Date: Aug. 19, 2010

(65) Prior Publication Data

US 2011/0226108 A1 Sep. 22, 2011

(30) Foreign Application Priority Data

Feb. 10, 2009 (DE) ..... 10 2009 008 278
Feb. 13, 2009 (DE) ..... 10 2009 008 936

(51) Int. Cl.

| | |
|---|---|
| ***B65H 35/02*** | (2006.01) |
| ***B26D 1/02*** | (2006.01) |
| ***B26D 1/03*** | (2006.01) |
| ***B26D 1/24*** | (2006.01) |
| ***B65B 41/16*** | (2006.01) |

(Continued)

(52) U.S. Cl.

CPC ..... *B65H 35/02* (2013.01); *B26D 1/025* (2013.01); *B26D 1/035* (2013.01); *B26D 1/245* (2013.01); *B65B 41/16* (2013.01); *B65B 59/00* (2013.01); *B65B 61/06* (2013.01); *B65H 23/025* (2013.01); *B65B 21/24* (2013.01); *B65B 53/063* (2013.01); *B65B 2220/06* (2013.01); *B65H 2301/351* (2013.01); *B65H 2301/4148* (2013.01); *B65H 2511/214* (2013.01); *B65H 2511/22* (2013.01); *Y10T 83/664* (2015.04)

(58) Field of Classification Search

CPC ..... Y10T 83/664; Y10T 83/6641; Y10T 83/6584; Y10T 83/6587; Y10T 83/6588; Y10T 83/6589; Y10T 83/2074; Y10T 83/2092; Y10T 83/2196; Y10T 83/22; B65H 23/025; B65H 23/038; B65H 23/26; B65H 39/14; B65H 39/16; B65H 35/02; B65H 2301/312; B65H 2301/3214; B65H 2301/35; B65H 2301/351; B65H 2404/10; B65H 2404/14; B65H 2404/15; B65H 2404/152; B65H 2404/1521

USPC ..... 83/436.3, 436.4, 425, 425.2–425.4, 83/102, 109, 156, 158

See application file for complete search history.

(56) References Cited

U.S. PATENT DOCUMENTS 1,863,520 A * 6/1932 Camerota ..... 198/785
1,931,454 A * 10/1933 Anderson ..... 198/448

(Continued)

FOREIGN PATENT DOCUMENTS

CA EP0316875 * 5/1989
DE 836437 4/1952

(Continued)

*Primary Examiner* — Phong Nguyen
(74) *Attorney, Agent, or Firm* — Occhiuti & Rohlicek LLP

(57) ABSTRACT

The invention relates to a cutting and expanding device for cutting a web of packaging material that is fed to the device via a web inlet into a plurality of individual webs that are conveyed away from the device at a web outlet and spaced apart from one another.

17 Claims, 2 Drawing Sheets

(51) Int. Cl.

| | |
|---|---|
| ***B65B 59/00*** | (2006.01) |
| ***B65B 61/06*** | (2006.01) |
| ***B65H 23/025*** | (2006.01) |
| *B65B 21/24* | (2006.01) |
| *B65B 53/06* | (2006.01) |

(56) References Cited

U.S. PATENT DOCUMENTS

| | | | | | |
|---|---|---|---|---|---|
| 2,760,773 | A | * | 8/1956 | Brodie | 242/615.21 |
| 3,623,645 | A | * | 11/1971 | Klingler | 242/615.21 |
| 3,734,487 | A | * | 5/1973 | Treff | 270/52.08 |
| 4,256,791 | A | * | 3/1981 | Holmstrom et al. | 428/77 |
| 4,960,234 | A | * | 10/1990 | Focke | 226/15 |
| 5,100,117 | A | * | 3/1992 | Hajek et al. | 270/52.08 |
| 5,357,859 | A | * | 10/1994 | Eckert | 101/228 |
| 6,994,005 | B2 | * | 2/2006 | Lamothe | 83/156 |

FOREIGN PATENT DOCUMENTS

| | | | |
|---|---|---|---|
| DE | 8717253 | * | 6/1988 |
| EP | 0309818 | | 4/1989 |
| EP | 0316875 | | 5/1989 |
| EP | 1661673 | | 5/2006 |
| JP | 2000318892 | | 11/2000 |

* cited by examiner

CUTTING-AND-SEPARATING DEVICE

CROSS-REFERENCE TO RELATED APPLICATIONS

This application is the National Stage of International Application No. PCT/EP2010/000314, filed on Jan. 20, 2010, which claims the priority of German Patent Application No. 10 2009 008 936.5, filed on Feb. 13, 2009 and German Patent Application No. 10 2009 008 278.6, filed on Feb. 10, 2009. The contents of the applications are hereby incorporated by reference in their entirety.

FIELD OF INVENTION

The invention relates to a cutting-and-separating device.

BACKGROUND

The processing of web-shaped flat materials in the form of packaging films, in particular shrink films on packaging machines and, in this case, especially on shrink packagers is known. In this case, products or packing means filled with products, such as, for example, bottles, cans, soft packaging, etc., but also sets made of up such products or packing means, are wrapped with packaging film. In a shrink tunnel connected to the packaging machine, the film is shrunk-on in such a manner that the film is placed fixedly around the respective product or packing means, thereby obtaining a robust, saleable packet or set.

The webs of flat material used for the packaging, which are, for example, produced from packaging or shrink foil, are usually made available in a web width that is greater than the web width that is required for the further processing. Consequently it is a common practice to cut the supplied web in a cutting-and-separating device once or twice in the longitudinal direction of the web to create two or three individual webs that have a web width that is more suitable for the packaging. In order to make it possible to process the individual webs, it is also necessary for the individual webs to be guided apart, i.e. separated, once they have been cut.

SUMMARY

It is an object of the invention to provide a cutting-and-separating device that, with a simplified structure, ensures a high level of flexibility with regard to the number of individual webs created by cutting.

In one aspect, the invention features an apparatus comprising a cutting-and-separating device for cutting a web of a packaging material into a plurality of individual webs. The cutting-and-separating device includes a web inlet for receiving the web of packaging material, a web outlet from which a plurality of individual webs that have been cut from the web of packaging material are spaced apart from each other and are conveyed away from the cutting-and-separating device, a longitudinal axis that extends along the cutting-and-separating device in a longitudinal direction thereof, a vertical reference plane that extends in a vertical direction and that intersects the longitudinal axis, an outer frame element, a cutting station, a plurality of rotatable rollers a plurality of roller groups, roller adjusting means, a set of outer bearings, a set of inner bearings, and an inner-bearing adjustment device. The vertical reference plane is common to all of the rollers, wherein each of the roller groups comprises at least two of the rotatable rollers. The roller groups are provided downstream of the web inlet along the device longitudinal axis. The roller adjusting means adjusts an inclined position of the rollers in relation to the vertical reference plane, the inclined position of a roller being defined by an angle made by an axis of the roller and the vertical reference plane. The cutting station is disposed at the web inlet. Each roller has an outer roller-end and an inner roller-end, and is mounted with the outer roller-end thereof on a corresponding outer bearing selected from the set of outer bearings in a region of the outer frame element. Each of the rollers is mounted with the inner roller-end on a corresponding inner bearing selected from the set of inner bearings. The inner-bearing adjustment device adjusts a position of the inner bearing.

In some embodiments, a number of the roller groups is equal to a maximum number of individual webs that can be produced by the cutting-and-separating device by cutting.

In other embodiments, the cutting station comprises a plurality of cutting tools.

In yet other embodiments, at least one roller of each roller group is adjustable in a direction of at least one of a longitudinal axis of the cutting-and-separating device, a web running direction, and a conveying direction.

Also included in embodiments of the invention are those in which at least one bearing associated with a roller group is adjustable in a direction of at least one of a longitudinal axis of the cutting-and-separating device, a web running direction, and a conveying direction.

Further embodiments include those in which the vertical reference plane is a plane that is perpendicular to a plane selected from the group consisting of a plane defined by the supplied web and a plane defined by at least one individual web that is conveyed away from the cutting-and-separating device at the web outlet.

In some embodiments, the cutting-and-separating device is symmetric around the vertical reference plane.

In other embodiments, rollers of each roller group are jointly adjustable, rollers of each roller group are arranged parallel to one another in each position of adjustment, and/or rollers can be adjusted between a position in which the rollers are oriented with their axes perpendicular to the reference plane and positions in which the axes of the rollers and the reference plane enclose an angle of less than 90° that opens towards the web outlet.

In some embodiments, a position of the outer bearing can be changed in order to change an inclined position of the rollers.

In other embodiments, each roller group consists of at most two rollers.

In yet other embodiments, the cutting-and-separating device consists of at most four roller groups.

The invention also includes embodiments that further comprise means for causing the rollers to apply gas to the web material.

Further developments, advantages, and application possibilities of the invention will be apparent from both the following description of exemplary embodiments, and the accompanying figures. In this case, all the features described and/or graphically represented, individually or in arbitrary combination are, in principle objects of the invention, irrespective of their summary in the claims or their dependency. The content of the claims is also made a part of the description.

BRIEF DESCRIPTION OF THE FIGURES

The invention is explained below by way of the Figures of an exemplary embodiment, in which, in detail.

DETAILED DESCRIPTION

Figure 1:
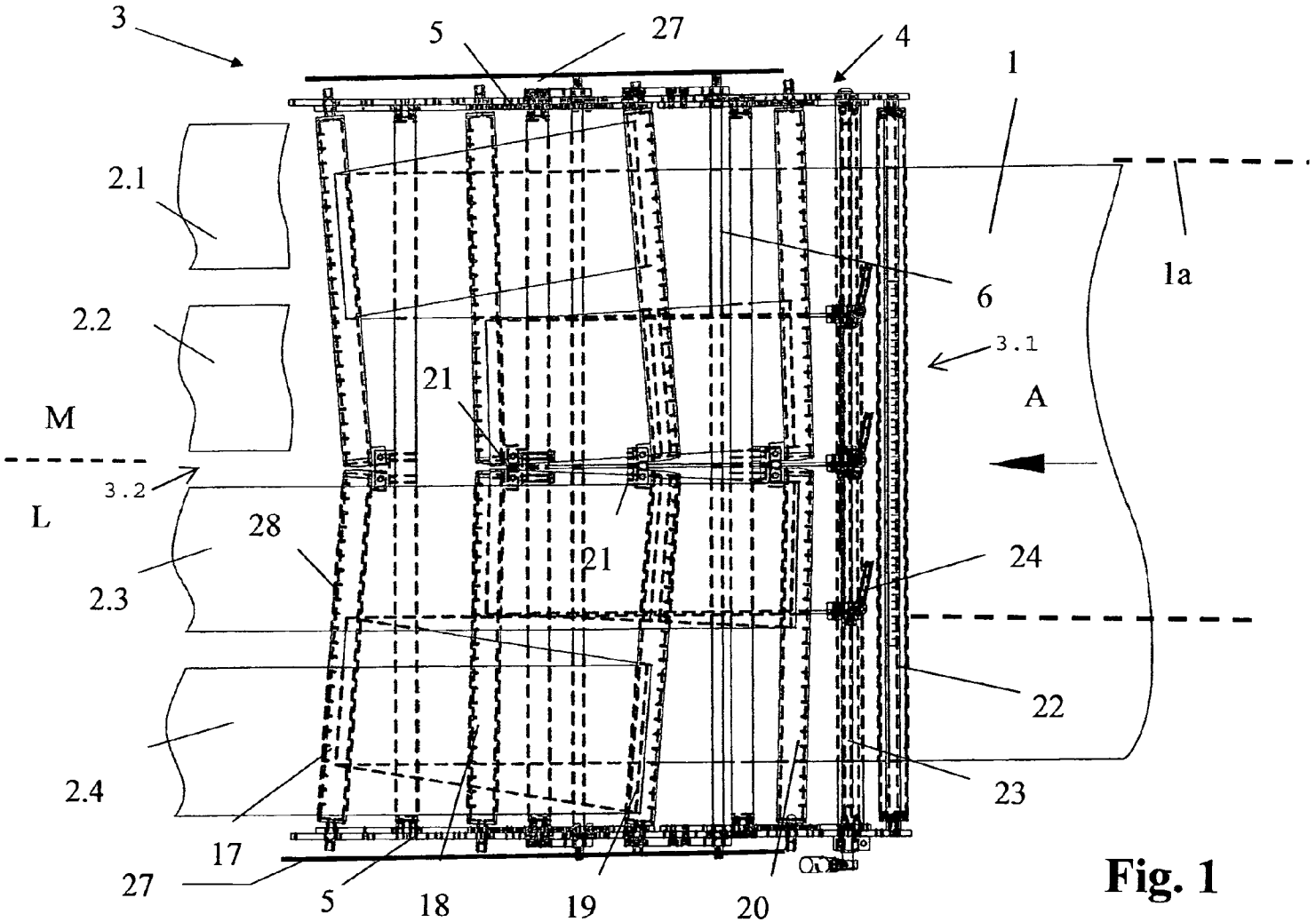
FIG. 1 shows a simplified representation and top view of a cutting-and-separating device according to the invention.

As shown in the figures, a web 1 of flat material is used to package products or packing means (not shown in any more detail) e.g. by means of a shrinking-on process in a packaging machine (not shown either). The web 1 can be in the form of a packaging material or a packaging film, for example in the form of a shrink film.

The web 1, which is supplied in a conveying direction A, is cut in the longitudinal direction. In the illustrated embodiment, the web 1 is cut in a continuous manner into a plurality of individual webs 2.1, 2.2, 2.3, 2.4. In the particular embodiment shown in FIG. 1, the four individual webs 2.1, 2.2, 2.3, 2.4 have identical widths.

A cutting-and-separating device 3 cuts and separates the web 2. In the cutting-and-separating device 3, the individual webs 2.1, 2.2, 2.3, 2.4 created by cutting the web 1 supplied to a web inlet 3.1 are not only cut, but also separated. In particular, the individual webs 2.1, 2.2, 2.3, 2.4 are guided apart in such a way that by the time the individual webs 2.1, 2.2, 2.3, 2.4 have moved away from the cutting-and-separating device 3 and reached a web outlet 3.2 in the conveying direction A, they have become spaced apart from each other.

The cutting-and-separating device 3 is substantially mirror-symmetric to a vertical center plane M. The vertical center plane M is oriented parallel to the conveying direction A of the web 1 and of the individual webs 2.1, 2.2, 2.3, 2.4 and is perpendicular to the plane of the webs.

The cutting-and-separating device 3 includes a device frame 4 with two flat or plate-like outer frame elements 5 that are arranged with their surface sides parallel to the conveying direction A and that extend vertically in planes perpendicular to the plane of the web 1. The frame elements 5 are spaced apart but are interconnected by crossheads 6 of the device frame 4. The distance between the frame elements 5 that are separated by crossheads 6 is greater than the width of the web 1 and also greater than the distance between the outer longitudinal sides of the two outer individual webs 2.1 and 2.4. The device frame 4 is oriented with its frame longitudinal axis L in the conveying direction A.

Figure 2:
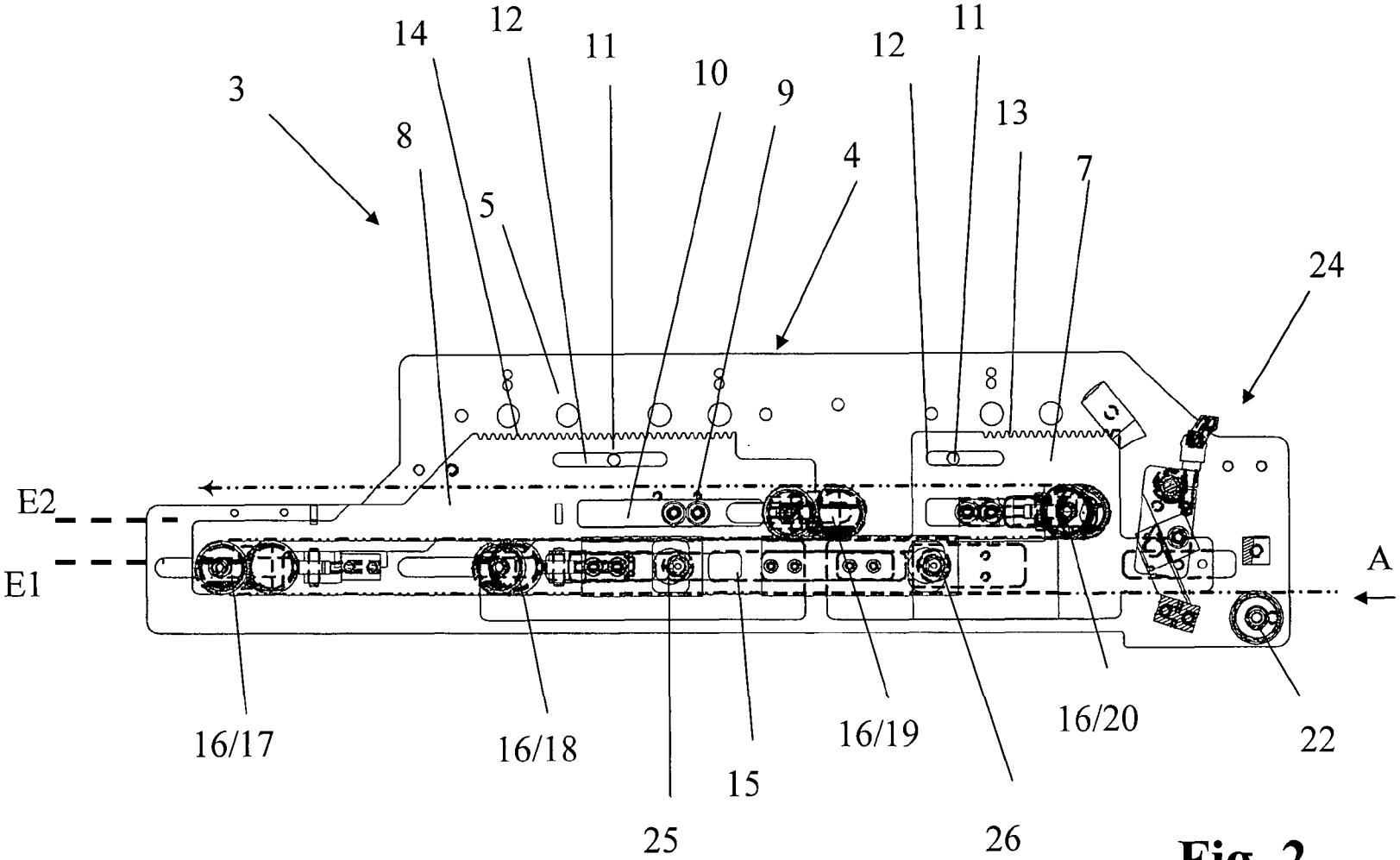
FIG. 2 shows a side view of the cutting-and-separating device in FIG. 1.

Referring now to FIG. 2, first and second adjusting plates 7, 8 are offset from each other in the direction of the frame longitudinal axis L on the outside of each frame element 5 away from the interior of the device frame 4. These adjusting plates 7, 8 abut against the inside surface of their associated frame element 5 and are provided on the frame element 5 so as to be displaceable by a predetermined travel in the direction of the frame's longitudinal axis L by a guide means.

The guide means that make the adjusting of the adjusting plates 7, 8 possible include, for example, guide rollers 9 and guide pins 11. The guide rollers 9 are rotatably mounted on the frame element 5 and are accommodated in slotted guide openings 10 in the adjusting plates 7, 8. The guide pins 11 engage associated slots 12 in the adjusting plates 7, 8 and at the same time also define the maximum possible travel of the adjusting plates 7, 8.

The adjusting plates 7, 8 are provided with teeth 13, 14 on upper sides thereof. The adjusting plate 7 on one side of the device frame 4 is connected in a driving manner to a corresponding adjusting plate on the other side of the device frame 4, via the teeth 13, by a transmission arrangement (not shown) that interacts with the teeth 13, that has a shaft (also not shown) that extends between the frame elements 5, and that is rotatably mounted in the frame elements. The adjusting plates 8 on both sides of the device frame 4, via their teeth 14 and a transmission arrangement including a shaft, are connected together in a driving manner in the same way. The adjusting of the adjusting plates 7, 8 is effected in a manual and/or motor-driven manner via the transmission arrangement. Preferably one single transmission arrangement is provided for all the adjusting plates 7, 8.

A coupling plate 15 is secured to each adjusting plate 7. The coupling plate extends away from the first adjusting plate 7 and overlaps the second adjusting plate 8 in a part region and at its end remote from the adjusting plate in the region of an opening in the second adjusting plate 8 having an outer bearing 16. Corresponding outer bearings 16 are also provided on the adjusting plates 7 and 8.

Referring back to FIG. 1, rollers 17, 18, 29, 20 are mounted so as to be freely rotatable in the device frame 4. Proceeding from the web outlet 3.2, and in a direction that is opposite to the conveying direction A, on each side of the center plane M there is a pair of first rollers 17, one on each side of the center plane M, connecting thereto a pair of second rollers 18, one on each side of the center plane M, one on each side of the center plane M, and connecting thereto a pair of third rollers 19, one on each side of the center plane M, and connecting thereto a pair of fourth rollers 20, one on each side of the center plane M. The rollers are therefore provided in duplicate. In the case of the embodiment represented, all the rollers 17, 18, 19, 20 are cylindrical structures having the same outside diameter.

In the embodiment represented, the first and second rollers 17 and 18 are arranged with their axes in a first common plane E1, best seen in FIG. 2, that is parallel or substantially parallel to the plane of the web 1 at the web inlet 3.1. Meanwhile, the axes of the third and fourth rollers 19 and 20 are arranged in a second common plane E2, which is also parallel or substantially parallel to the plane of the web 1 at the web inlet 3.1. The second common plane E2 is offset above the plane E1 by a spacing that is at least equal the diameter of the rollers 17, 18, 19, 20.

The first and third rollers 17, 19 are mounted so as to be freely rotatable by way of an outer end in an outer bearing 16 in one of the adjusting plates 8, and, by way of an inner end in the region of the center plane M, in a central bearing 21.

The two first rollers 18 are mounted so as to be freely rotatable by way of their outer ends in each case in an outer bearing 16 in a coupling plate 15 and at their inner ends in the region of the center plane M in an inner bearing 21. The two fourth rollers 20 are rotatably mounted at their outer ends in an outer bearing 16 at the adjusting plate 7 and at their inner ends adjacent the center plane M in inner bearings 21. The inner bearings 21 are, for example, provided in each case on one of the crossheads 6 or on an inner frame element that is connected to the crossheads 6.

A further roller 22, which extends over the entire width of the device frame 4, is mounted at the web inlet 3.1 between the frame elements 5 so as to be freely rotatable. This further roller 22 is used to support the web 1.

A plurality of cutting devices 24 is provided at the web inlet 3.1 at a crosshead 23 following the further roller 22 in the conveying direction A. Each of the cutting devices 24, in the embodiment represented, is formed by a cutting knife. The cutting knives cut the web 1 into individual webs 2.1, 2.2, 2.3, 2.4. The cutting devices 24 are adjustable along the crosshead 23 in the plane of the web 1 and in a direction that is perpendicular to the conveying direction A. In addition, each cutting device 24 is individually moveable between a cutting state, in which it cuts the web 1, and a non-operational state, in which it does not. This transition can occur, for example, by pivoting the cutting device 24.

As can be seen in FIG. 1, the rollers 17, 18, 19, 20 are inclined so that the axes of the rollers are not exactly perpendicular to the conveying direction A. In particular, the rollers make an angle relative to a ray that extends in the conveying direction A. This angle is less than 90°.

As can also be seen in FIG. 1, the arrangement is additionally such that the first and third rollers 17, 19 and the second and fourth rollers 18, 20 in each case form a roller group on each side of the center plane M such that the rollers of each roller group are arranged with their axes parallel or substantially parallel to each other.

Three cutting devices 24 are provided to cut the web 1 into the four individual webs 2.1, 2.2, 2.3, 2.4. In the illustrated example, the cutting devices 24 are disposed so that all of the individual webs 2.1, 2.2, 2.3, 2.4 have the same width. Thus, as shown in FIG. 1, the distance between the two outer cutting devices 24 and the respective edge of the web 1 and the mutual distance between two cutting devices 24 is equal to the widths of the individual webs 2.1, 2.2, 2.3, 2.4.

The two outer individual webs 2.1, 2.4 are created with the two outer cutting devices 2.4. These individual webs extend initially within the cutting-and-separating device 3 in each case to one of the first rollers 17, then around the first roller 17, upward to one of the third rollers 19, around the third rollers 19, and upward again such that the relevant outer individual web 2.1, 2.4 leaves the cutting-and-separating device above the plane E2.

The central individual webs 2.2, 2.3 are created by the outer cutting devices 24 and by the central cutting device 24. These webs 2.2, 2.3 extend within the cutting-and-separating device 3 initially to one of the second rollers 18, then around this second roller 18, upward to one of the fourth rollers 20, around this roller 20, and upward such that the relevant central individual web 2.2, 2.3 leaves the cutting-and-separating device 3 in the conveying direction A once again above the plane E2.

Through the inclined position of the rollers 17, 18, 19, 20, the expanding of the individual webs 2.1, 2.2, 2.4, 2.4 is achieved in such a manner that the individual webs at the web outlet 3.2 are parallel to each other and are spaced apart from each other. The distances between the individual webs 2.1, 2.2, 2.4, 2.4 are adjustable through the inclined position of the rollers 17, 18, 19, 20.

As shown in FIG. 1, the inclined position of the second and fourth rollers 18, 20 is less than the inclined position of the first and third rollers 17, 19, i.e. the angle enclosed by the axes of the second and third rollers 18, 20 and a ray in the center plane M and extending in the conveying direction A is greater than the corresponding angle between that ray and the axes of the first and third rollers 17, 19.

The inclined positions of the rollers 17, 18, 19, 20, and consequently the spacings between the individual webs 2.1, 2.2, 2.3, 2.4 are adjustable by displacing the first and second adjusting plates 7 and 8. The outer and inner bearings 16 and 21 are realized such that they enable the adjustment or the change in the inclined position of the rollers 17, 18, 19, 20.

The cutting-and-separating device 3 thus offers the possibility of separating the supplied web 1 by cutting it into four individual webs 2.1, 2.2, 2.3, 2.4 and, for example, of adjusting the distance between the individual webs 2.1, 2.2, 2.3, 2.4 by changing the inclined position of the rollers 17, 18, 19, 20. But it is also possible, with the cutting-and-separating device 3, to separate a supplied web 1 into only two individual webs. In such a case, only the central cutting device 24 is used. The two individual webs thus created by cutting are then guided, for example, via the second and fourth rollers 18, 20.

It is also possible to separate a web 1 into three individual webs. Usually, in this case the central knife is removed or taken out of engagement. The second and fourth rollers 18 and 20 are set for guiding the central web such that they are aligned in an identical manner, that is to say they have a common axis of rotation.

In addition, it is possible for the web 1 to be supplied to the web inlet 3.1 in a manner that is not symmetrical with reference to the center plane M. This is indicated in FIG. 1 by the broken lines for the web 1*a*. Using two cutting devices 24 the asymmetrically fed web 1*a* is separated into the individual webs 2.1, 2.2, 2.3, of which a first individual web 2.1 is guided around the first and third rollers 17, 19 and second and third individual webs 2.2, 2.3 are guided in each case via the second and fourth rollers 18, 20.

Obviously, the cutting-and-separating device 3 can also be used such that the supplied web 1 is supplied via the web outlet 3.2 to a further use uncut, i.e. in the form of one single web. In this case, at least the rollers that interact with the web, for example the second and fourth rollers 18, 20, are then set such that they are oriented with their axes, in each case, perpendicular to the center plane M.

FIG. 2 shows first and second eccentric adjusting devices 25, 26 by way of which the inner bearings 21 of the rollers 17, 18, 19, 20, at least however a minimum of one inner bearing 21 of each roller group 17, 19 and 18, 20, are adjustable in the longitudinal direction of the frame L, this being the inner bearings 21 of the rollers 18 and/or 20 via the adjusting device 25 and the inner bearings 21 of the rollers 17 and/or 19 via the adjusting device 26. In order to achieve this, the adjusting of the crossheads 6 or frame elements on which the inner bearings 21 are provided is effected in each case via the first or second adjusting device 25, 26.

Referring again to FIG. 1, gas lines 27 connect to a source of a pressurized gas, for example to a compressed air source. The gas lines 27 are connected via rotary connectors to roller channels within the rollers 17, 18, 19, 20. These roller channels communicate with a plurality of outlet or nozzle openings 28 on the circumferential or lateral surface of the rollers 17, 18 19, 20. During the operation of the cutting-and-separating device 3, the webs 2.1, 2.2, 2.3, 2.4 are blown-off from inside by the compressed air emerging from the nozzle openings 28, thereby reducing friction between the respective web and the rollers interacting with that web, and the tension on the cut individual webs 2.1, 2.2, 2.3, 2.4.

The cutting-and-separating device 3 makes it possible for two, three or four webs to be created by cutting from one supplied web 1 and also for the supplied web 1 to be supplied uncut to a further use.

Through the adjusting device that is formed by the adjusting plates 7 and 8 and the adjusting elements 25 and 26, it is not only possible to adjust the angle of the rollers 17, 18, 19, 20 with reference to the center plane M, but also to adjust the rollers in the longitudinal direction L of the device frame 4 and consequently to adjust the respective web length inside the cutting-and-separating device 3. In particular, in this way it is possible to make an adjustment in such a manner that the lengths of the individual webs 2.1, 2.2, 2.3, 2.4 situated in the cutting-and-separating device 3 in each case is precisely identical, which is of great importance in particular when processing webs 1 in the form of printed packaging films or shrink films.

A further advantage of the cutting-and-separating device 3 arises from its compact design and in the fact that, through the free accessibility of the rollers 17, 18, 19, 20, it is also possible to introduce the respective web-shaped flat material with a relatively small amount of effort, the same also being true of changing between cutting the supplied web 1 into two webs, three webs and four webs.

Regardless of the number of webs created by cutting, the flat material is guided in each case only via a few rollers or directional axes. This produces not only a sturdy design but also less tension on the individual webs 2.1, 2.2, 2.3, 2.4 guided away from the cutting-and-separating device 3 at the web outlet 3.2.

A further essential advantage is that the individual webs 2.1, 2.2, 2.3, 2.4 lie in a common plane even at the web outlet 3.2, thereby simplifying the production of subsequent devices for processing the individual webs.

The driving connection at least between the first adjusting plates 7 associated with each other and the second adjusting plates 8 associated with each other achieves a same-directional parallel adjustment of the second and fourth rollers 18, 20 or the first and third rollers 17, 19, with the advantage of simplified adjustability of the cutting-and-separating device 3.

The invention has been described above by way of an exemplary embodiment. It is obvious that numerous changes and conversions are possible without in any way departing from the inventive concept underlying the invention.

LIST OF REFERENCE NUMERALS

1 Web made of flat material
2.1-2.4 Individual webs created by cutting
3 Cutting-and-separating device
3.1 Web inlet
3.2 Web outlet
4 Device frame
5 Frame element
6 Crosshead
7, 8 Adjusting plate
9 Guide roller
10 Slotted hole
11 Guide pin
12 Slotted hole
13, 14 Teeth
15 Coupling plate
16 Bearing
17-20 Roller
21 Bearing
22 Support roller
23 Crosshead
24 Cutting device
25, 26 Adjusting device
27 Line
28 Nozzle opening on lateral surface of the roller 17-20
A Feed direction of the web 1 or of individual webs 2.1-2.4
L Device longitudinal axis
M Vertical center plane

The invention claimed is:

1. An apparatus comprising a cutting-and-separating device for cutting a web of a packaging material into a plurality of individual webs, said cutting-and-separating device comprising a web inlet for receiving said web of packaging material, a web outlet from which a plurality of individual webs that have been cut from said web of packaging material are spaced apart from each other and are conveyed away from said cutting-and-separating device, a longitudinal axis that extends along said cutting-and-separating device in a longitudinal direction thereof, a vertical reference plane that extends in a vertical direction and that intersects said longitudinal axis, first and second outer frame elements, a cutting station, a plurality of rotatable rollers, a plurality of roller groups, roller adjusting means, a set of outer bearings, a set of inner bearings, and an inner-bearing adjustment device, wherein said vertical reference plane is common to all of said rollers, wherein each of said roller groups comprises at least two of said rotatable rollers, wherein said roller groups are provided downstream of said web inlet along said device longitudinal axis, wherein said roller adjusting means adjusts an inclined position of said rollers in relation to said vertical reference plane, wherein an inclined position of a roller is defined by an angle made by an axis of said roller and said vertical reference plane, wherein said cutting station is disposed at said web inlet, wherein each of said rollers has an outer roller-end and an inner roller-end, wherein each of said rollers is mounted with said outer roller-end thereof on a corresponding outer bearing selected from said set of outer bearings in a region of one of said first and second outer frame elements, wherein each of said rollers is mounted with said inner roller-end on a corresponding inner bearing selected from said set of inner bearings, and wherein said inner-bearing adjustment device adjusts a position of said inner bearing, wherein said first outer frame element comprises a first adjustable plate, wherein said first adjustable plate comprises walls forming said first slot, wherein said first adjustable plate is adjustable for movement along said longitudinal axis, wherein said second outer frame element comprises a second adjustable plate, wherein said second adjustable plate comprises walls forming said second slot, wherein said second adjustable plate is adjustable for movement along said longitudinal axis, wherein said roller groups comprise a first roller group, wherein said first roller group comprises a first roller and a second roller, wherein said first roller has a first outer roller end and a first inner roller end, wherein said first outer roller end passes through said first slot, wherein said first inner roller end engages an inner bearing, wherein said second roller has a second outer roller end and a second inner roller end, wherein said second outer roller end passes through said second slot, and wherein said second inner roller end engages said inner bearing.

2. The apparatus of claim 1, wherein a number of said roller groups is equal to a maximum number of individual webs that can be produced by said cutting-and-separating device by cutting.

3. The apparatus of claim 1, wherein said cutting station comprises a plurality of cutting tools.

4. The apparatus of claim 1, wherein at least one roller of each roller group is adjustable in a direction of at least one of a longitudinal axis of said cutting-and-separating device, a web running direction, and a conveying direction.

5. The apparatus of claim 1, wherein at least one bearing associated with a roller group is adjustable in a direction of at least one of a longitudinal axis of said cutting-and-separating device, a web running direction, and a conveying direction.

6. The apparatus of claim 5, wherein the at least one bearing is adjustable independently of adjustment of the inclined position.

7. The apparatus of claim 1, wherein said vertical reference plane is a plane that is perpendicular to a plane selected from the group consisting of a plane defined by said supplied web and a plane defined by at least one individual web that is conveyed away from said cutting-and-separating device at said web outlet.

8. The apparatus of claim 1, wherein said cutting-and-separating device is symmetric around said vertical reference plane.

9. The apparatus of claim 1, wherein said roller adjustment means jointly adjusts rollers of each roller group.

10. The apparatus of claim 9, wherein rollers of each roller group are arranged parallel to one another in each position of adjustment.

11. The apparatus of claim 1, wherein said rollers can be adjusted between a position in which the rollers are oriented with their axes perpendicular to the reference plane and positions in which the axes of the rollers and the reference plane enclose an angle of less than 90° that opens towards the web outlet.

12. The apparatus of claim 1, wherein a position of said outer bearing can be changed in order to change an inclined position of said rollers.

13. The apparatus of claim 1, wherein each roller group consists of at most two rollers.

14. The apparatus of claim 1, wherein said cutting-and-separating device consists of at most four roller groups.

15. The apparatus of claim 1, further comprising means for causing said rollers to apply gas to said web material.

16. The apparatus of claim 1, wherein said rollers are coplanar.

17. The apparatus of claim 1, wherein a roller of each roller group is adjustable, as a whole, in a web running direction, wherein said roller is adjustable by a first amount, wherein each point on said roller undergoes displacement by said first amount along said web direction, wherein said rod has a center of mass, wherein said center of mass rod undergoes displacement by said first amount along said web direction, and wherein said center of mass undergoes zero displacement in any direction other than said web direction.

* * * * *